United States Patent [19]

Kilmer

[11] 4,170,923

[45] Oct. 16, 1979

[54] LAUNCH LUG RETRACTOR ASSEMBLY

[75] Inventor: LeMoyne L. Kilmer, Florissant, Mo.

[73] Assignee: The United States of America as represented by the Secretary of the Air Force, Washington, D.C.

[21] Appl. No.: 896,832

[22] Filed: Apr. 17, 1978

[51] Int. Cl.[2] ..... F41F 7/00

[52] U.S. Cl. ..... 89/1.819; 89/1.5 G

[58] Field of Search ..... 89/1.819, 1.806, 1.5 R, 89/1.5 G; 244/137 R; 294/83 R

[56] References Cited

U.S. PATENT DOCUMENTS

| | | | |
|---|---|---|---|
| 2,750,842 | 6/1956 | Myers | 89/1.5 F |
| 2,852,981 | 9/1958 | Caya | 89/1.5 G |
| 3,115,059 | 12/1963 | Moul | 89/1.819 |
| 3,153,980 | 10/1964 | Kongelbeck | 89/1.819 |
| 3,183,777 | 5/1965 | Damm | 89/1.5 R |
| 3,186,302 | 6/1965 | Price | 89/1.806 |
| 3,195,406 | 7/1965 | Toomey | 89/1.819 |
| 3,967,529 | 7/1976 | Ingle et al. | 89/1.819 |

*Primary Examiner*—David H. Brown

*Attorney, Agent, or Firm*—Joseph E. Rusz; Arsen Tashjian

[57] ABSTRACT

An assembly for retracting missile launch lugs out of the airstream, to reduce aerodynamic drag, after the missile has been launched from an aircraft. The assembly, which is integrated with the missile, includes: an aerodynamically configurated housing; a lug fitting that is positioned within the housing and is movable through an opening in the housing; and a spring, within the housing and attached to the lug fitting and to the housing, for biasing the lug fitting to remain within, or to return into, the housing. Unlike the prior art, the assembly: permits the automatic retraction of the exposed launch lugs after missile launch; does not result in the ejection of any element or component during or after launch, and therefore precludes potential damage to the missile or to the aircraft; and, is adaptable for use in combination with a left-hand or a right-hand missile.

3 Claims, 3 Drawing Figures

LAUNCH LUG RETRACTOR ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates generally to the art of launching missiles from an airborne vehicle, such as an aircraft, and more particularly to a launch lug retractor assembly. For illustrative purposes, and not because of any inherent limitation, the preferred embodiment of the invention is adapted for use in combination with a missile that is integrated with the invention, and also is adapted for concurrent use with an aircraft having a missile launcher with launcher hooks. The integrated combination of the missile and of the invention is suspended and is supported from the launcher hooks, and is launched from the aircraft from and by the launcher.

Currently, most missiles have fixed exposed launch lugs, and no provisions are made to retract, or to eject, these supports (i.e., the launch lugs) after separation of the missiles from the carrying aircraft. To reduce the aerodynamic drag on the missile, and thereby to improve its performance, it is desirable to remove drag-producing devices, such as launch lugs, from the airstream.

I have invented an assembly which, unlike the prior art, permits automatic retraction of the exposed launch lugs of a missile, after the missile is launched; and, thereby, I have significantly advanced the state-of-the-art.

SUMMARY OF THE INVENTION

This invention, a missile launch lug retractor assembly, permits the automatic retraction of exposed launch lugs of a missile, that is carried in a missile launcher by an aircraft, when the missile is launched from the aircraft.

Accordingly, the principal object of this invention is to teach the structure of a preferred embodiment of my above-described inventive assembly.

This principal object, as well as other related objects (e.g., easy and rapid "bench-checking" of the assembly prior to installation and use), will become readily apparent after a consideration of the description of the inventive assembly, together with reference to the Figures of the drawings, wherein the same component, element and the like, has the same reference numeral and the like.

DESCRIPTION OF THE PREFERRED EMBODIMENT

Figure 1:
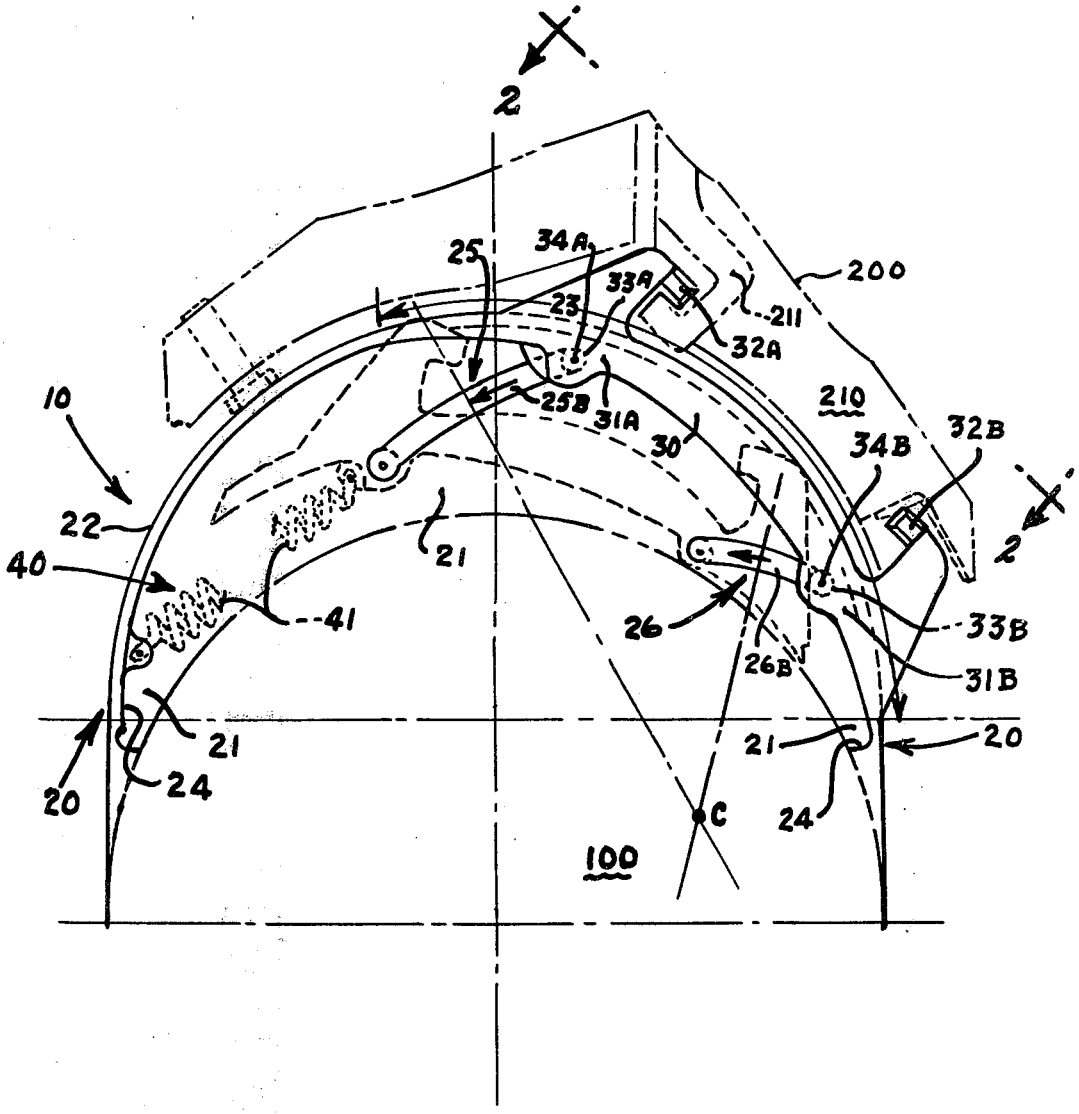
FIG. 1 is a transverse front view, in simplified form, partially schematic and partially fragmented, of a preferred embodiment of my invention integrated with and to a representative missile, in the working environment, suspended and supported by a representative missile launcher on an aircraft.
Figure 2:
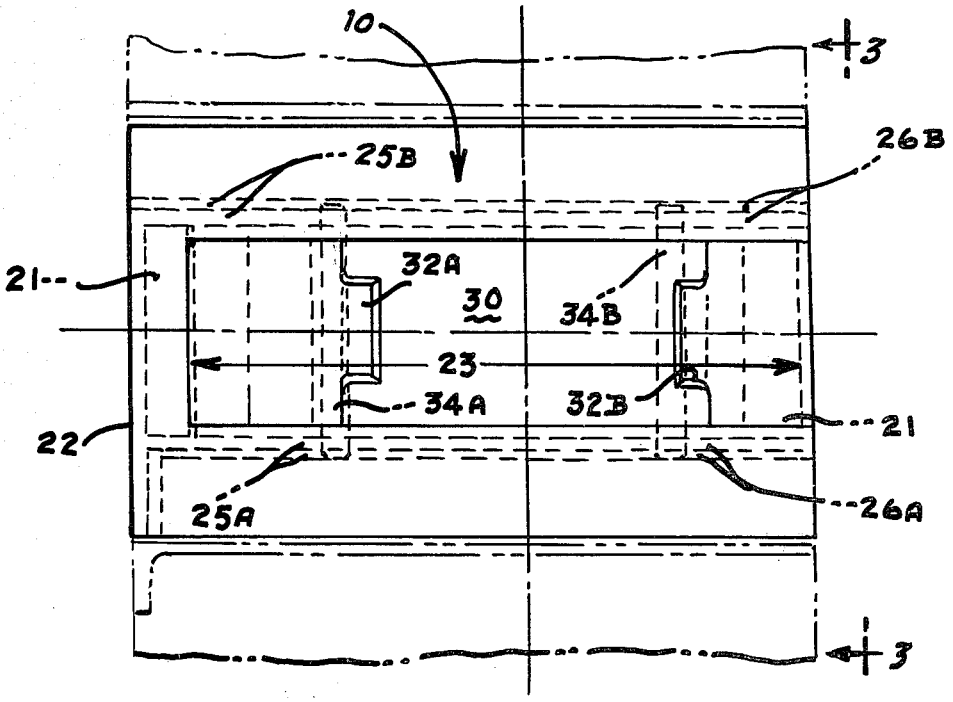
FIG. 2 is the view of the preferred embodiment, the missile and the launcher, as seen along line 2—2 in FIG. 1.
Figure 3:
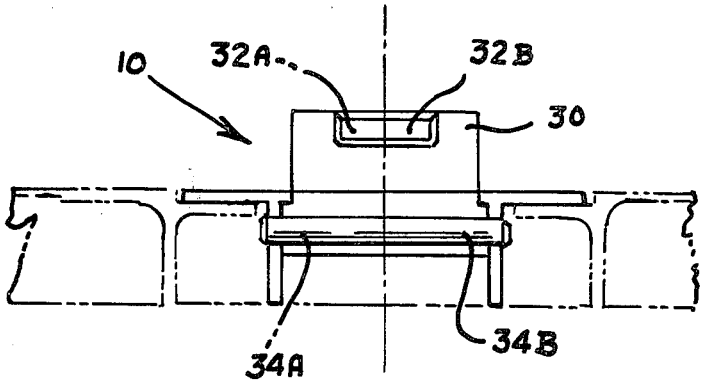
FIG. 3 is the view of the preferred embodiment, missile and launcher, as seen along line 3—3 in FIG. 2.

With reference to FIGS. 1-3, inclusive, therein is shown, in simplified form and in three views, the preferred embodiment 10 of my invention, a missile launch lug retractor assembly.

In the most basic and generic structural form, the assembly 10, which is combined and integrated with representative missile 100, and (together with missile 100) is suspended and supported from launcher 210 (with representative launcher hook 211) of aircraft 200, comprises: a housing 20; a lug fitting 30 that is disposed within the housing 20 and is movable through an opening 23 in the housing 20; and, means, generally designated 40, for biasing the lug fitting 30.

More specifically, the housing 20 is aerodynamically configurated, such as is shown in FIG. 1; has a cavity 21; has an external surface 22 with an opening 23 therein and therethrough leading to, and interconnecting with, the cavity 21; and, has an internal surface 24 with a first set of slots 25 and a second set of slots 26 located in the internal surface 24, with each set of slots 25 and 26 including a first slot 25A and a second slot 25B in slot set 25 and a first slot 26A and 26B in slot set 26, and with the slots in each set of slots being identical and oppositely disposed (e.g., slots 25A and 25B are identical and are oppositely disposed) and slots 26A and 26B are identical (to each other, but not necessarily to slots 25A and 25B) and are oppositely disposed.

The lug fitting 30 is generally arcuate-shaped; is disposed within the cavity 21 of the housing 20; is insertable into, and removable from the cavity 21; and, is movable through (i.e., in and out of) the opening 23 of housing 20. The lug fitting has a first end 31A with a first lug 32A and a first hole 33A thereat, and also has a second end 31B with a second lug 32B and a second hole 33B thereat. A first pin 34A is in first hole 33A; extends outwardly and through the hole 33A; and, protrudes through on either side of the fitting 30 itself. Similarly, a second pin 34B is in second hole 33B; extends outwardly and through the hole 33B; and, protrudes through on both sides of the fitting 30. The first pin 34A is slidably movable within the first set 25 of slots 25A and 25B, and the second pin 34B is slidably movable within the second set 26 of slots 26A and 26B.

It is here to be noted, as shown in FIG. 1: that the second slot 25B of the first set 25 of slots is shaped in the geometric form of an arc of a first circle; that the second slot 26B of the second set 26 of slots is shaped in the geometric form of an arc of a second circle; and, that the first circle and the second circle have a common center point "C", FIG. 1. Similarly, the first slot 25A of the first set 25, and the first slot 26A of the second set 26 are arcs, respectively, of a third and of a fourth circle that have a common center point. Although it is preferred that all of the circles (i.e., the first, second, third and fourth circles) have a common center (i.e., (i.e.,, that the common center point of the first and second circles, and the common center point of the third and fourth circles, coincide), such is not necessary. For example, slots 25A and 26A could be in one (i.e., a first) plane, as the arcs of concentric circles; whereas, slots 25B and 26B could be in another (i.e., a second) plane, as the arcs of concentric circles, with this second plane being parallel to the first plane.

The means 40 for biasing the first end 31A of the lug fitting 30 is disposed within the cavity 21 of the housing 20, and is interposed between, and is connected to, the first end 31A of the lug fitting 30 and the internal surface 24 of the housing 20. Preferably, this biasing means includes a retraction tension spring 41, as shown in FIG. 1.

FIG. 2 shows, in simplified form, what is seen as viewed along line 2—2 of FIG. 1; and, likewise, FIG. 3 shows, also in simplified form what is seen as viewed along line 3—3 of FIG. 2. These views are furnished: to show components that are not readily depictable, either in whole or in part, in FIG. 1 without encumbering that figure; and, also to better orient the reader, if he is not skilled in the art to which this invention pertains.

MANNER OF OPERATION OF THE PREFERRED EMBODIMENT

The manner of operation of the preferred embodiment 10 can be easily ascertained by any person of ordinary skill in the art from the foregoing description, coupled with reference to the Figures of the drawings.

For others, it is sufficient to say in explanation that, the lugs 32A and 32B, FIGS. 1-3, inclusive, are inherently held in the deployed (i.e., outward) position as shown in FIG. 1 by installation of the missile 100 in or to the launcher 210 of aircraft 200. Action by means 40, FIG. 1, and more specifically by spring 41, FIG. 1, results in the retraction of the lugs 32A and 32B only when the missile is freed from, and is free of, the launcher 210. Stated another way, when the missile 100, FIG. 1, is released, the tension spring 41, FIG. 1, pulls the lug fitting 30, FIG. 1, to a retracted position (as shown in phantom in FIG. 1) inside of the housing 20 (i.e., through the opening 23 and into the cavity 21).

CONCLUSION

It is abundantly clear from all of the foregoing, and from the Figures of the drawings, that the stated desired principal object, as well as other related objects, of the invention (such as: nothing is ejected during retraction, thereby precluding potential damage to the missile or to the launching aircraft, during or after missile separation; and, the passive nature of the invention, i.e., no power supply or attendant control mechanism is required in order to operate it, presents no hazard to personnel during handling, storage, or installation) have been achieved.

It is to be noted that, although there have been described the fundamental and unique features of my invention as applied to a preferred embodiment thereof, various other embodiments, variations, adaptations, substitutions, additions, omissions, and the like may occur to, and can be made by, those of ordinary skill in the art, without departing from the spirit of the invention. For example: (a) my invention may be adapted for use, in combination with any missile(s), where there is a limited stowage space in a fairing or in the missile(s); and, my invention may be adapted for use in combination with a left-hand or right-hand missile.

What is claimed is:

1. A missile launch lug retractor assembly, adapted for use in combination with a missile with which said assembly is integrated, and also adapted for concurrent use with an aircraft having a missile launcher with launcher hooks, from which hooks said integrated combination of missile and missile launch lug retractor assembly is supported, and from which launcher said integrated combination is launched, comprising:

a. an aerodynamically configurated housing having a cavity, and having an external surface with an opening therein and therethrough leading to, and interconnecting with, said cavity, and also having an internal surface with a first set and a second set of slots located therein, wherein each set of slots includes a first slot and a second slot that are identical and are oppositely disposed;

b. a generally arcuate-shaped lug fitting having a first end with a first lug and a first hold thereat and with a first pin in said first hole and extending therethrough, and also having a second end with a second lug and a second hole thereat and a second pin in said second hole and extending therethrough, wherein said first pin is slidably movable within said first set of slots, and said second pin is slidably movable within said second set of slots, and wherein said lug fitting is disposed within said cavity of said housing and also is movable through said opening in said housing;

c. and, means for biasing said first end of said lug fitting, wherein said biasing means is disposed within said cavity in said housing, and also is interposed between, and is connected to, said first end of said lug fitting and said internal surface of said housing.

2. A missile launch lug retractor assembly, as set forth in claim 1, wherein said second slot of said first set of slots is shaped in the geometric form of an arc of a first circle, and wherein said second slot of said second set of slots also is shaped in the geometric form of an arc and comprises an arc of a second circle, and also wherein said first circle and said second circle have a common center point.

3. A missile launch lug retractor assembly, as set forth in claim 2, wherein said means for biasing said first end of said lug fitting includes a spring.

* * * * *